United States Patent [19]

Rattmann

[11] Patent Number: 4,522,093

[45] Date of Patent: Jun. 11, 1985

[54] SLICER FEED MECHANISM

[75] Inventor: James A. Rattmann, Sun Prairie, Wis.

[73] Assignee: General Foods Corporation, White Plains, N.Y.

[21] Appl. No.: 588,267

[22] Filed: Mar. 12, 1984

[51] Int. Cl.[3] ..... B26D 3/22

[52] U.S. Cl. ..... 83/42; 83/355; 83/422; 83/342; 83/418

[58] Field of Search ..... 83/37, 42, 76, 77, 340, 83/342, 355, 418, 422, 672, 703, 713

[56] References Cited

U.S. PATENT DOCUMENTS

| | | | |
|---|---|---|---|
| 2,642,910 | 6/1953 | Garapolo | 83/355 |
| 3,910,143 | 10/1975 | Wallace et al. | 83/342 |
| 4,015,494 | 4/1977 | Spooner et al. | 83/76 |
| 4,309,927 | 1/1982 | Dennis et al. | 83/77 |
| 4,321,847 | 3/1982 | Dillon | 83/77 |

*Primary Examiner*—Donald R. Schran

*Attorney, Agent, or Firm*—Joseph T. Harcarik; Thomas R. Savoie; Daniel J. Donovan

[57] ABSTRACT

A food product is fed to and through a slicer blade of the type included within a commercial-scale meat slicer such as that used in slicing pork bellies into bacon slices. A slidable shelf is provided for temporarily storing the food product and for depositing the food product generally along a feed path after the butt portion of a previously sliced food product hassubstantially cleared the feed path. The thus deposited food product is then pushed into a prefeed orientation and gripped for feeding to and through the slicer blade.

18 Claims, 5 Drawing Figures

SLICER FEED MECHANISM

DESCRIPTION

This invention generally relates to feeding a product to a slicer, more particularly to feeding a food product to and through a slicer therefor, which includes automatically depositing a food product on the feed pathway to the slicer and aligning the thus deposited food product into a prefeed orientation.

Large scale production of food products has long included the use of slicing devices by which unitary products such as pork bellies, are fed to and through a slicing blade, typically one exhibiting rotary motion, in order to thereby slice the unitary product into relatively thin items, such as bacon slices. In such operations, the sliced items are then subjected to additional handling to eventually result in a packaged product suitable for appropriate commercial or institutional distribution.

Often, in these types of commercial-scale food processing operations, it is necessary or at least preferred to have a worker inspect or otherwise observe or participate in the subsequent handling of the sliced products. In a traditional operation for slicing bacon or the like, much of the effort of one worker is needed to continuously feed bacon bellies or the like into the commercial-scale slicer, and it is difficult for this worker to perform any other duties such as inspecting the sliced bacon or the like. It would, accordingly, be desirable and economically advantageous to provide an apparatus and method which would permit the worker or operator of the slicing device to be able to reduce the amount of time and energy that he or she must devote to the operation of feeding pork bellies or the like to the slicer device, which would enable the operator to perform other functions downstream of the slicing device itself.

Such results have been attained by the present invention, by which at least one bacon belly or the like is automatically fed into and properly aligned within the feed path of the slicing device. A slidable shelf is provided which is generally parallel to the existing feed path of a commercial-scale slicing apparatus. A rear pusher or stop plate assembly is provided at a location along this slidable shelf and generally above the location at which the slicing apparatus grips the rear or feed-trailing end of the food product. As a result, when the slidable shelf moves in a direction away from the slicing blade, the food product drops into the feed path of the slicing apparatus. Thereafter, an automatic aligning assembly properly locates the food product into an aligned prefeed orientation with respect to the slicing blade, after which the slicing apparatus accomplishes the desired slicing of the food product.

It is accordingly a general object of the present invention to provide an improved feed mechanism that is especially suitable for use in feeding food products to a slicing blade.

Another object of this invention is to provide an improved slicing apparatus and method for feeding and slicing a food product such as a pork belly, wherein a plurality of pork bellies or the like are accommodated by the feed mechanism.

Another object of the present invention is to provide an improved apparatus and method for slicing a food product which allows the operator of the feed mechanism to devote a portion of his or her time to operations other than those of feeding food product to the slicer.

Another object of this invention is to provide an improved apparatus and method which utilizes a semi-automatic feed assembly that includes a sliding shelf structure upon which food products are stored and from which the food products drop onto the feed path of a conventional slicing apparatus.

These and other objects of the present invention will be apparent from the following description of this invention, taken in conjunction with the accompanying drawings, wherein.

Figure 1:
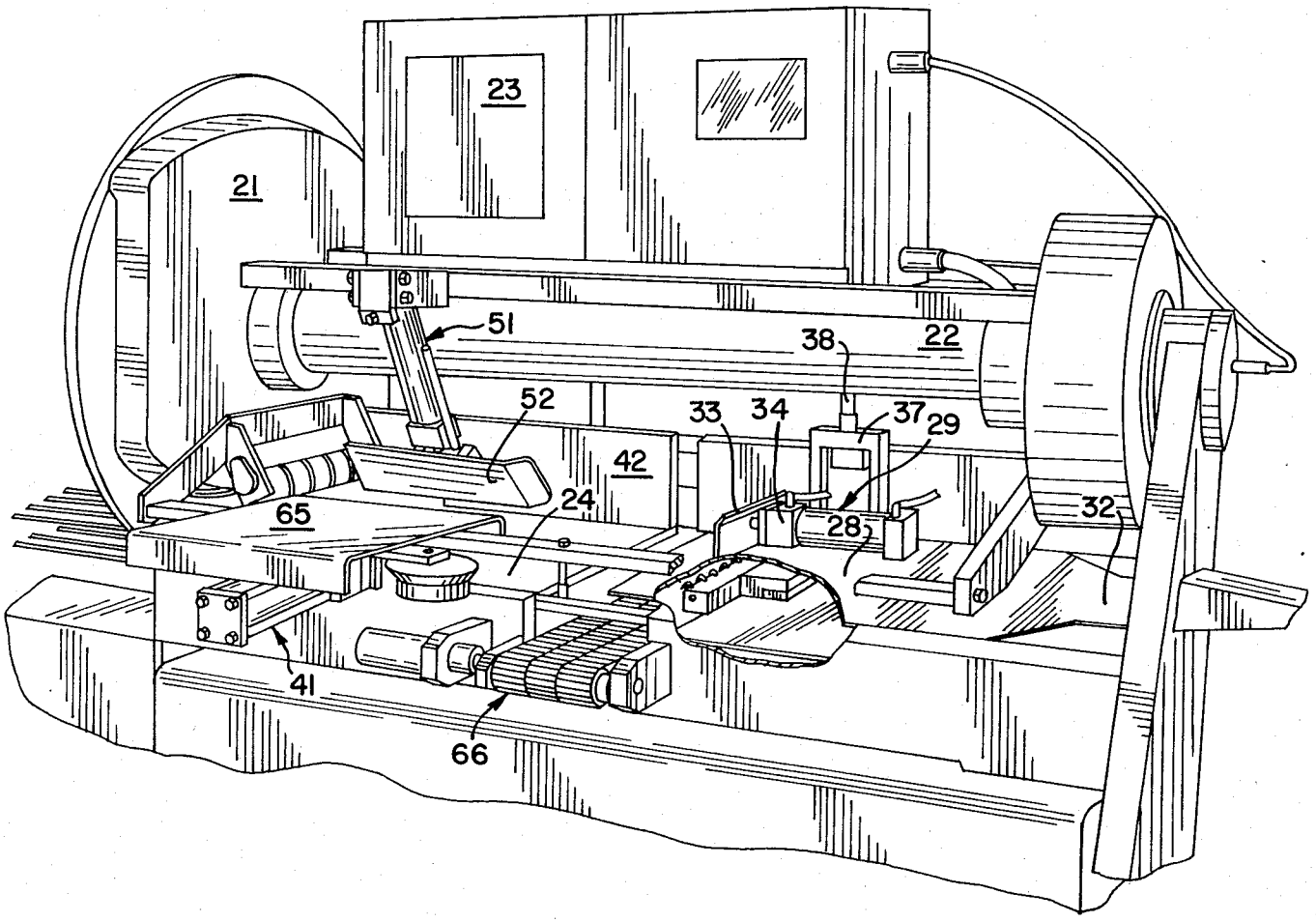
FIG. 1 is a perspective view of the slicing apparatus feed mechanism according to this invention.
Figure 3:
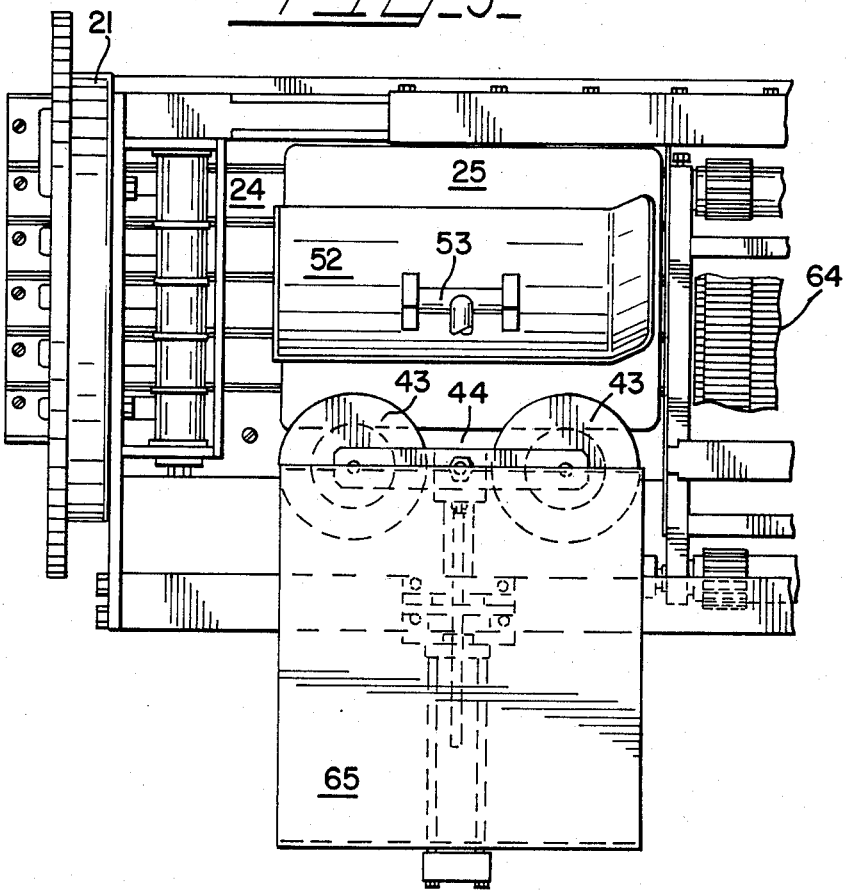
FIG. 3 is an enlarged plan view, partially broken away, of the automatic aligning assembly.

A slicing apparatus, generally shown in FIG. 1, includes a slicing blade assembly 21, which is of a generally known construction, the blade being driven by a blade drive assembly 22, also of generally known and commercially available construction. A control panel, generally designated at 23, is also included. The apparatus includes a support assembly 24, which is the primary support for a food product such as a bacon belly 25 (FIGS. 3 and 5), the feed path for the food product being generally along the support assembly 24. A movable gripper assembly, generally designated as 26 and of generally known construction, is provided for gripping the food product 25, pushing the food product 25 to and through the slicing blade assembly 21, and retracting a butt portion 27 (FIG. 4) of the food product 25 after slicing has been completed.

Figure 2:
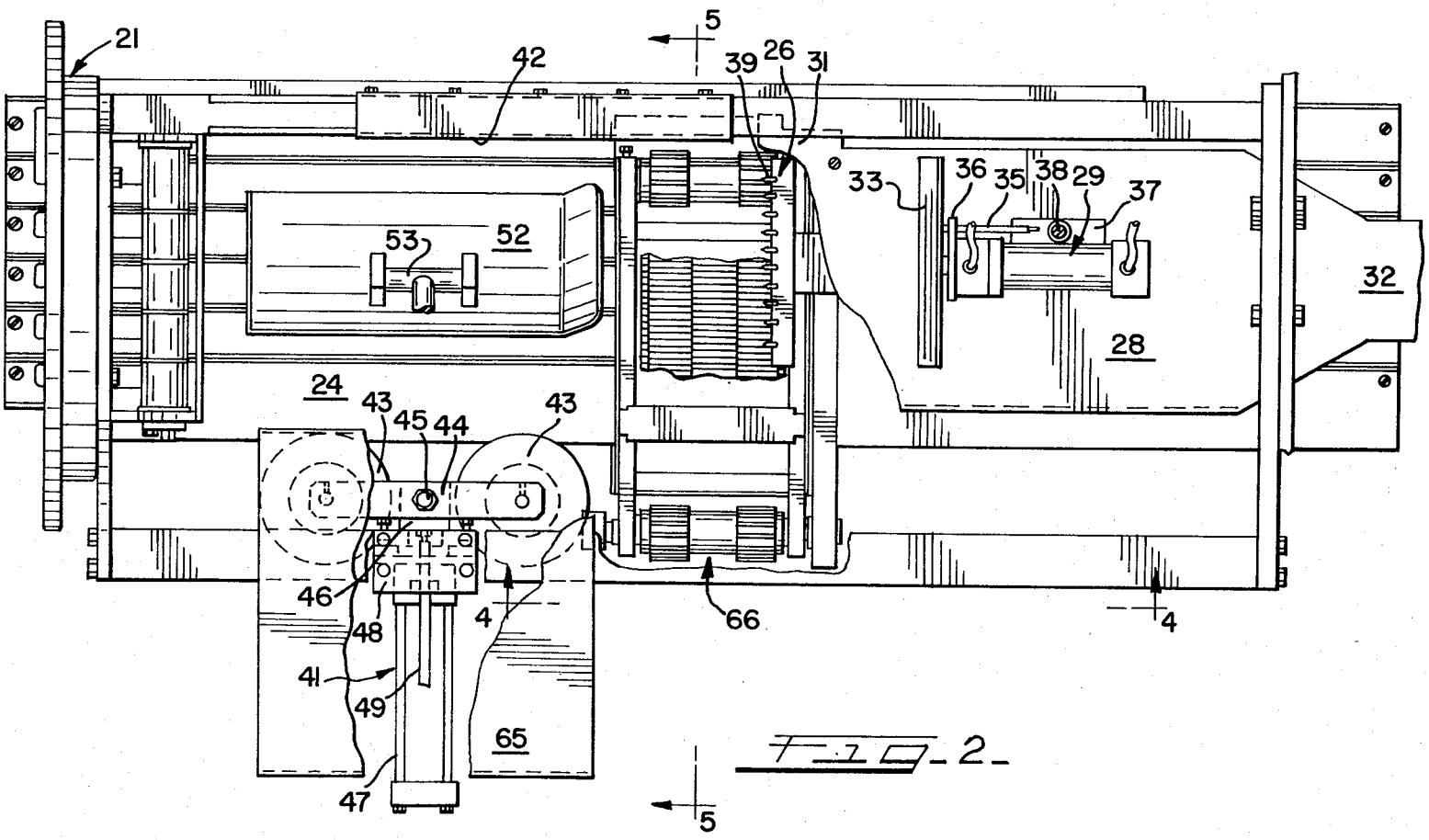
FIG. 2 is a plan view, partially broken away, of the apparatus illustrated in FIG. 2.

A slidable shelf assembly 28 is spaced above and is generally parallel to the support assembly 24. The slidable shelf assembly 28 is shown in its fully retracted position in FIGS. 1 and 2 and in its generally extended position in FIG. 4. Slidable shelf assembly 28 supports a food product such as bacon belly 25*a* illustrated in FIG. 4 during the time that the food product or bacon belly 25 is being fed along the feed path including the support assembly 24.

Once the gripper assembly 26 has substantially retracted the butt portion 27, the slidable shelf assembly 28 moves to its retracted position, whereby, in conjunction with a rear pusher assembly, generally designated as 29, the food product or bacon belly 25*a* drops onto the feed path including the support assembly 24. The slidable shelf assembly 28 is slidably mounted to the apparatus in a manner such that the slidable shelf assembly 28 provides a relatively clear passageway thereunder so as to afford adequate clearance for feeding of the food product or bacon belly 25 along the support assembly 24. In this regard, support for the slidable shelf is preferably provided along a longitudinal edge portion 31 and a drive extension 32 of the slidable shelf assembly 28.

Referring more particularly to the rear pusher assembly 29, such includes a pusher plate 33 mounted onto a cylinder 34 of generally known construction. In order to insure accuracy of movement of the pusher plate 33, it is preferred to include a guide rod 35 in association with a guide plate 36. The rear pusher assembly 29 is suitably mounted, such as by means of a bracket 37 and a guide post 38, onto a generally stationary portion of the apparatus, such as the housing of the blade drive assembly 22.

The rear pusher assembly 29 cooperates with the retractive movement of the slidable shelf assembly 28, which is rearward movement of the slidable shelf assembly 28 away from the slicing blade assembly 21, in order to strip the food product or bacon belly 25*a* from off of the slidable shelf assembly 28, which product 25*a* then drops onto the support assembly 24. After such food product or bacon belly 25*a* drops onto the feed path including the support assembly 24, this product 25*a* is designated herein as the food product or bacon belly 25 that is generally positioned along the length of the feed path such that the gripper assembly 26 will, consistent with the timing thereof, engage the rear end of the product 25. The timing of the gripper assembly 26 is such that the claws 39 thereof dig into and grip the trailing or rear end of the food product or bacon belly 25.

In most instances, when the food product or bacon belly 25 first drops onto the feed path including the support assembly 24, the food product or bacon belly 25 will not be properly aligned in a front-and-back orientation with respect to the slicing blade assembly 21. A pusher assembly, generally designated at 41, is provided in this regard. Pusher assembly 41 operates in association with an opposing and generally vertical wall 42 which partially defines the feed path and which provides a pushing force in a direction generally transverse to the feed path along the support assembly 24. The pusher assembly 41 includes one or more pusher wheels 43, or a similar structure. The components which engage the food product 25 are made of a material that is suitable for contacting food products.

With more particular reference to the illustrated pusher assembly 41, each pusher wheel 43 is mounted to a pusher bar 44, which in turn is mounted onto a pivot pin 45 and a pivot block 46. The pivot block 46 is mounted to a cylinder 47 of generally known construction, which cylinder 47 is rigidly mounted to the apparatus by a cylinder mounted 48. A guide rod 49 may be provided in order to maintain a generally parallel horizontal alignment of pusher bar 44 with respect to the support assembly 24.

After the retracting slidable shelf assembly 28 and the rear pusher assembly 29 have deposited the food product or bacon belly 25 onto the support assembly 24, the pusher assembly 41 is activated. More particularly, the cylinder 47 extends the pivot block 46, and one or more of the pusher wheels 43 engages the product 25. In the event that the product 25 is not generally parallel to the opposing wall 42, then it is likely that only one of the pusher wheels 43 will initially engage the product 25, as a result of which the pusher bar 44 will rotate on the pivot pin 45 in order to assist in movement of the product 25 until the opposite edge thereof engages the opposing wall 42 with both pusher wheels 43 engaging the product 25.

Figure 5:
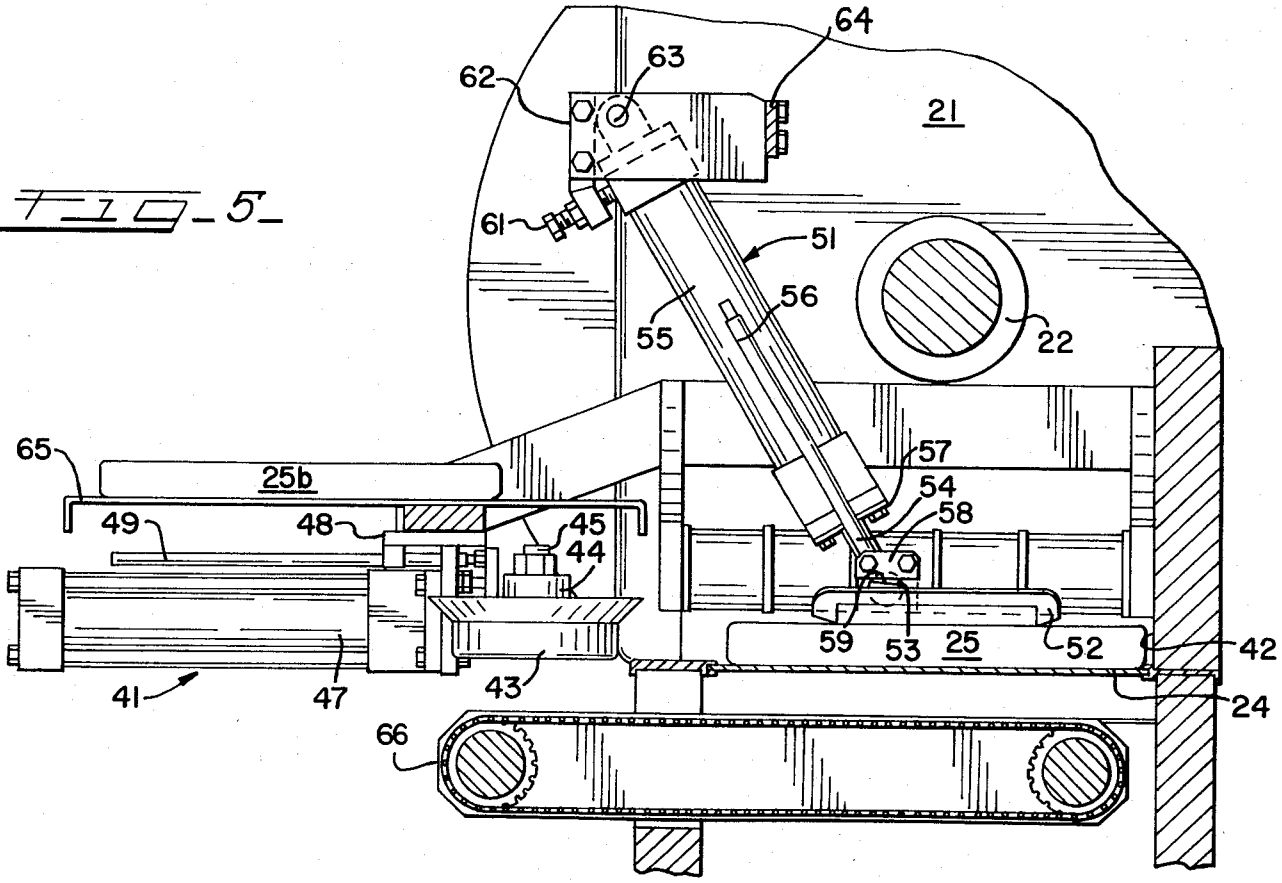
FIG. 5 is a sectional view along the line 5—5 of FIG. 2.

A hold down assembly, generally designated as 51, is provided in conjunction with moving the product 25 to the prefeed orientation with respect to the slicing blade assembly 21. Hold down assembly 51 is particularly useful in the event that the food product or bacon belly 25 is generally bendable or flexible. Hold down assembly 51 includes a dead plate 52 which contacts the upper surface of the food product or bacon belly 25, as generally illustrated in FIG. 5, in order to insure that the food product or bacon belly 25 is in a vertical orientation wherein the entire bottom surface of the product 25 rests on the feed path including the support assembly 24.

With further reference to the hold down assembly 51, the dead plate 52 is pivotally mounted onto a pin 53 which is mounted to a cylinder rod 54 of a cylinder 55. An appropriate guide rod 56 and guide plate 57 are provided in order to insure proper alignment of the dead plate 52 with respect to the cylinder 55. A stop 58 is provided in order to limit rotation of the dead plate 52 on the pin 53, typically in association with a flat 59. By this arrangement, the dead plate 52 will rotate no further than the position generally illustrated in FIG. 1.

Angular orientation of the cylinder 55 and its rod 54 can be varied by means of an adjustable stop 61. Adjustable stop 61 depends from a suitable bracket 62, from which the cylinder 55 is also mounted by a suitable pin and bearing assembly 63. The bracket 62 is secured to the apparatus by a suitable structure such as a mounting bar 64 or the like.

A stationary shelf 65 is provided at a location generally adjacent to and above the feed path including the support assembly 24. A food product or bacon belly 25*b* can be temporarily supported by the shelf 63, from which position, the operator can easily slide the food product or bacon belly 25*b* onto the slidable shelf 28, or, typically upon start up of the apparatus, onto the support assembly 24.

Figure 4:
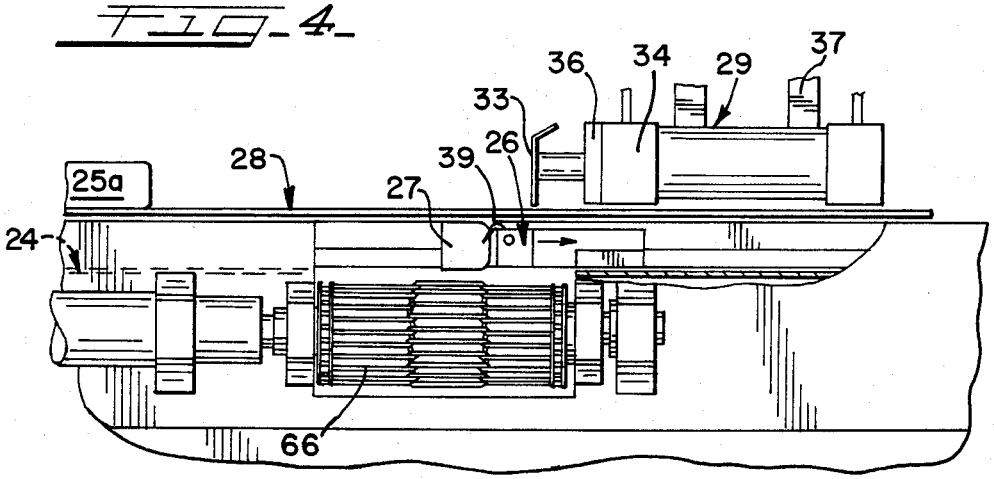
FIG. 4 is an elevation view, generally along the line 4—4 of FIG. 2 and partially broken away, illustrating the gripper assembly and rear pusher assembly.

When the gripper assembly 26 has retracted the butt portion 27 to the position generally illustrated in FIG. 4, the claws 39 are retracting out of the butt portion 27 and the butt portion 27 drops onto a conveyor assembly 66 for conveyance away from the apparatus and into a suitable collection bin (not shown).

It is to be appreciated that this invention can be embodied in various forms and therefore is to be construed and limited only by the scope of the appended claims.

I claim:

1. A feed mechanism of the type that feeds a food product to a slicing assembly having a slicer blade, the feed mechanism including a support assembly for slidingly supporting a food product, and a gripper assembly for gripping a rear end of the food product and for moving the gripped food product along the support assembly and to the slicer blade, the feed mechanism including a semi-automatic feed assembly comprising:

a slidable shelf assembly generally parallel to the support assembly, said slidable shelf assembly being at a height greater than the height of the support assembly;

a rear pusher assembly closely spaced from the top surface of the slidable shelf assembly and generally rearwardly located with respect to the slicing assembly; and means for automatically aligning a food product into a prefeed orientation with respect to the slicer blade and with respect to the gripper assembly, said automatic aligning means including means for pushing against the food product, and said prefeed orientation being below said slidable shelf assembly.

2. The feed mechanism as claimed in claim 1, wherein the rear pusher assembly includes means for pushing the food product off of the slidable shelf assembly and onto the support assembly.

3. The feed mechanism as claimed in claim 1, wherein said slidable shelf assembly has an extended orientation that is spaced generally vertically above said support assembly, and wherein said slidable shelf assembly has a retracted orientation that is generally rearward of said extended orientation.

4. The feed mechanism as claimed in claim 1, wherein said rear pusher assembly includes pusher means for engaging a food product on said slidable assembly and for assisting in moving the food product off of the slidable shelf assembly and onto said support assembly.

5. The feed mechanism as claimed in claim 1, wherein said automatic aligning means includes a pusher assembly having a pusher member generally horizontally spaced from and generally horizontally extendable to a location closely spaced above said support assembly, said automatic aligning means further including a wall generally adjacent to the support assembly, said wall being along a side of the support assembly that is generally opposite to said pusher assembly.

6. The feed mechanism as claimed in claim 1, wherein said automatic aligning means is for providing a pushing force in a direction generally transverse to said support assembly.

7. The feed mechanism as claimed in claim 1, wherein said automatic aligning means includes a pusher wheel, and wherein said automatic aligning means moves said pusher wheel generally horizontally of said support assembly at a location closely spaced above said support assembly.

8. The feed mechanism as claimed in claim 1, wherein said automatic aligning means includes pivotally mounted pusher wheels.

9. The feed mechanism as claimed in claim 1, wherein said automatic aligning means includes hold down means for applying pressure onto the top surface of the food product on the support assembly.

10. The feed mechanism as claimed in claim 1, wherein said automatic aligning means includes a hold down assembly having a dead plate, said hold down assembly including means for moving said dead plate generally upwardly and downwardly with respect to said support assembly.

11. The feed mechanism as claimed in claim 1, wherein said automatic aligning means includes a wall generally adjacent to said support assembly, pusher means for generally horizontally moving the food product into general engagement with said wall, and wherein said automatic aligning means further includes hold down means for providing a generally vertical force onto the food product while same is on said support assembly.

12. The feed mechanism as claimed in claim 1, further including a stationary shelf generally horizontally spaced from said slidable shelf assembly.

13. A method for feeding a food product to a location for slicing the food product, during which the rear end of the food product is gripped and the food product is fed along a feed path and to the slicing location, comprising:

positioning a food product onto a slidable shelf located above and generally parallel to the feed path;

moving the slidable shelf in a direction generally away from the slicing location while engaging the food product to limit its movement away from the slicing location, whereby the food product on the slidable shelf slides off of the slidable shelf and drops onto the feed path;

automatically aligning the food product on the feed path into a prefeed orientation that is aligned with respect to the slicing location;

gripping the food product and feeding the gripped food product to the slicing location in order to slice the food product into a plurality of slices; and moving the slidable shelf in a direction generally toward the slicing location and above the feed path of the food product.

14. The method as claimed in claim 13, wherein said automatic aligning step includes moving the food product generally horizontally on the feed path and generally transverse to feed path movement direction.

15. The method as claimed in claim 13, wherein said automatic aligning step includes applying a generally downwardly directed force onto the food product on the feed path.

16. The method as claimed in claim 13, wherein said step of moving the slidable shelf in a direction away from the slicing location is accompanied by applying a force on the food product in a direction generally toward the slicing location.

17. The method as claimed in claim 13, further including retracting a butt portion of the food product generally before the food product drops off of the slidable shelf and onto the feed path.

18. The method as claimed in claim 13, wherein the food product is a bacon belly.

* * * * *

UNITED STATES PATENT AND TRADEMARK OFFICE

CERTIFICATE OF CORRECTION

PATENT NO. : 4,522,093

DATED : 6/11/85

INVENTOR(S) : James A. Rattmann

It is certified that error appears in the above-identified patent and that said Letters Patent are hereby corrected as shown below:

On the cover page, the Assignee, delete "General Foods Corporation" and insert --Oscar Mayer Foods Corporation --.

Signed and Sealed this

*Seventeenth* Day of *September 1985*

[SEAL]

*Attest:*

DONALD J. QUIGG

*Attesting Officer*

*Commissioner of Patents and Trademarks—Designate*